US009924823B2

(12) United States Patent
Asper

(10) Patent No.: US 9,924,823 B2
(45) Date of Patent: Mar. 27, 2018

(54) GROUNDED CHRISTMAS TREE

(71) Applicant: Jon Scott Asper, Riverside, CA (US)

(72) Inventor: Jon Scott Asper, Riverside, CA (US)

( * ) Notice: Subject to any disclaimer, the term of this patent is extended or adjusted under 35 U.S.C. 154(b) by 0 days.

(21) Appl. No.: 15/439,230

(22) Filed: Feb. 22, 2017

(65) Prior Publication Data

US 2017/0156535 A1 Jun. 8, 2017

Related U.S. Application Data

(63) Continuation of application No. 14/170,303, filed on Jan. 31, 2014, now abandoned.

(51) Int. Cl.
*H01R 4/66* (2006.01)
*A47G 33/12* (2006.01)

(52) U.S. Cl.
CPC ..... *A47G 33/12* (2013.01); *H01R 4/66* (2013.01); *A47G 2033/122* (2013.01)

(58) Field of Classification Search
CPC ..... H01R 4/60; H01R 4/66; H01R 13/648; H05B 39/00; A47G 2033/122
See application file for complete search history.

(56) References Cited

U.S. PATENT DOCUMENTS 1,598,016 A * 8/1926 Runser ..... A47G 33/12 248/524
2,984,808 A * 5/1961 Bender ..... H01R 13/652 439/104
3,603,780 A * 9/1971 Lu ..... A47G 33/06 362/123
3,685,000 A * 8/1972 Robbins ..... H01R 27/00 439/103
3,783,340 A 1/1974 Becker
4,861,288 A 8/1989 Friedman
5,213,516 A * 5/1993 Okamoto ..... H01R 13/652 439/104
5,625,345 A * 4/1997 Stark ..... A47G 33/12 340/521
5,757,597 A * 5/1998 Frank, Sr. ..... F21V 21/06 361/42
6,087,946 A * 7/2000 Menard, Jr. ..... A47G 33/0881 340/618
6,088,960 A * 7/2000 Hartzog ..... A47G 33/0881 340/620
6,320,327 B1 * 11/2001 Lavatelli ..... A47G 33/126 315/185 S
9,439,528 B2 * 9/2016 Chen ..... A47G 33/06
2006/0044789 A1 * 3/2006 Curtis ..... F21S 8/088 362/152

* cited by examiner

*Primary Examiner* — Xuong Chung Trans
(74) *Attorney, Agent, or Firm* — Techlaw LLP; Sam K. Tahmassebi

(57) ABSTRACT

Disclosed herein are cords comprising two live wires and a ground wire, wherein the ground wire terminates in a probe configured to be placed in a water basin at the base of a Christmas tree. Also disclosed herein are cords comprising two live wires and a ground wire, wherein the ground wire terminates in a probe configured to be placed in a trunk of a Christmas tree. Also disclosed herein are bases for a Christmas tree, the base comprising a GFI socket, wherein the GFI socket is in electrical communication with a ground wire, wherein the ground wire terminates in a probe; wherein the GFI socket is in electrical communication with a three-wire cord, configured to be plugged into a wall socket.

6 Claims, 5 Drawing Sheets

GROUNDED CHRISTMAS TREE

CROSS-REFERENCE TO RELATED APPLICATIONS

The present invention is a continuation of U.S. patent application Ser. No. 14/170,303, filed Jan. 31, 2014, the contents of which are incorporated herein by reference.

FIELD OF THE INVENTION

The present invention is in the field of electrical supplies and in particular, it is in the field of providing a grounded Christmas tree water reservoir.

BACKGROUND OF THE DISCLOSURE

It is common practice during the Christmas holiday to decorate a Christmas tree with lights. The Christmas tree commonly sits in a water reservoir to keep the Christmas tree fresh during the holiday season and avoid the excessive dropping of needles. In some circumstances, the water reservoir becomes electrically charged. When an individual or an animal comes into contact with the water reservoir, the individual receives an electric shock. This can create a dangerous, or at least an unpleasant, situation for the individual, for example a crawling infant, or for a pet.

SUMMARY OF THE INVENTION

Disclosed herein are cords comprising two live wires and a ground wire, wherein the ground wire terminates in a probe configured to be placed in a water basin at the base of a Christmas tree. Also disclosed herein are cords comprising two live wires and a ground wire, wherein the ground wire terminates in a probe configured to be placed in a trunk of a Christmas tree. Also disclosed herein are bases for a Christmas tree, the base comprising a GFI socket, wherein the GFI socket is in electrical communication with a ground wire, wherein the ground wire terminates in a probe; wherein the GFI socket is in electrical communication with a three-wire cord, configured to be plugged into a wall socket.

BRIEF DESCRIPTION OF THE DRAWINGS

FIG. 5A is a drawing showing an embodiment of a grounded extension cord for use with a fresh cut tree, whereas

FIG. 6A is a drawing showing an embodiment of a grounded water reservoir having a GFI socket, whereas

DETAILED DESCRIPTION OF THE EMBODIMENTS

The present inventor has discovered that under some circumstances the water reservoir in the base of a Christmas tree becomes electrically charged. This is especially true when the tree stand is made of plastic or other insulating material, which does not conduct electricity. This problem does not exist with metallic tree stands, because the metal base acts to ground the water reservoir as it conducts the electricity to the ground. This automatic grounding does not exists with the plastic tree stands, or with stands that have an insulating base.

Without being bound to any particular theory, the present inventor postulates that the Christmas tree lights cause the accumulation of electric potential. AC Christmas lights are typically wrapped around the tree and plugged into an electrical outlet. As the current flows through the wire, it creates an electric field. This electric field has the potential to conduct to the trunk of the tree and create an electric potential between the tree and the ground. The problem exists because the wires wrapped around the tree act like windings of a transformer. As current flows through the wire it creates a magnetic field, which causes an electric potential, resulting in the ions within the tree trunk to move. That is, the current in the wire causes an electrical current in the tree trunk. This phenomenon occurs in both freshly cut trees, where the sap acts as the conductor, and artificial trees, where the tree trunk is metal, which is conductive. If the tree base is not electrically grounded, the potential for the accumulation of electric potential exits. In a freshly cut tree, which is placed in a water reservoir, the water acts as an exposed conductor. In an artificial tree, the metallic trunk and limbs act as an exposed conductor.

Disclosed herein are devices and methods that provide an earth ground for the tree and/or its accompanying base. The disclosed devices and methods are further explained in reference to the drawings.

Figure 1:
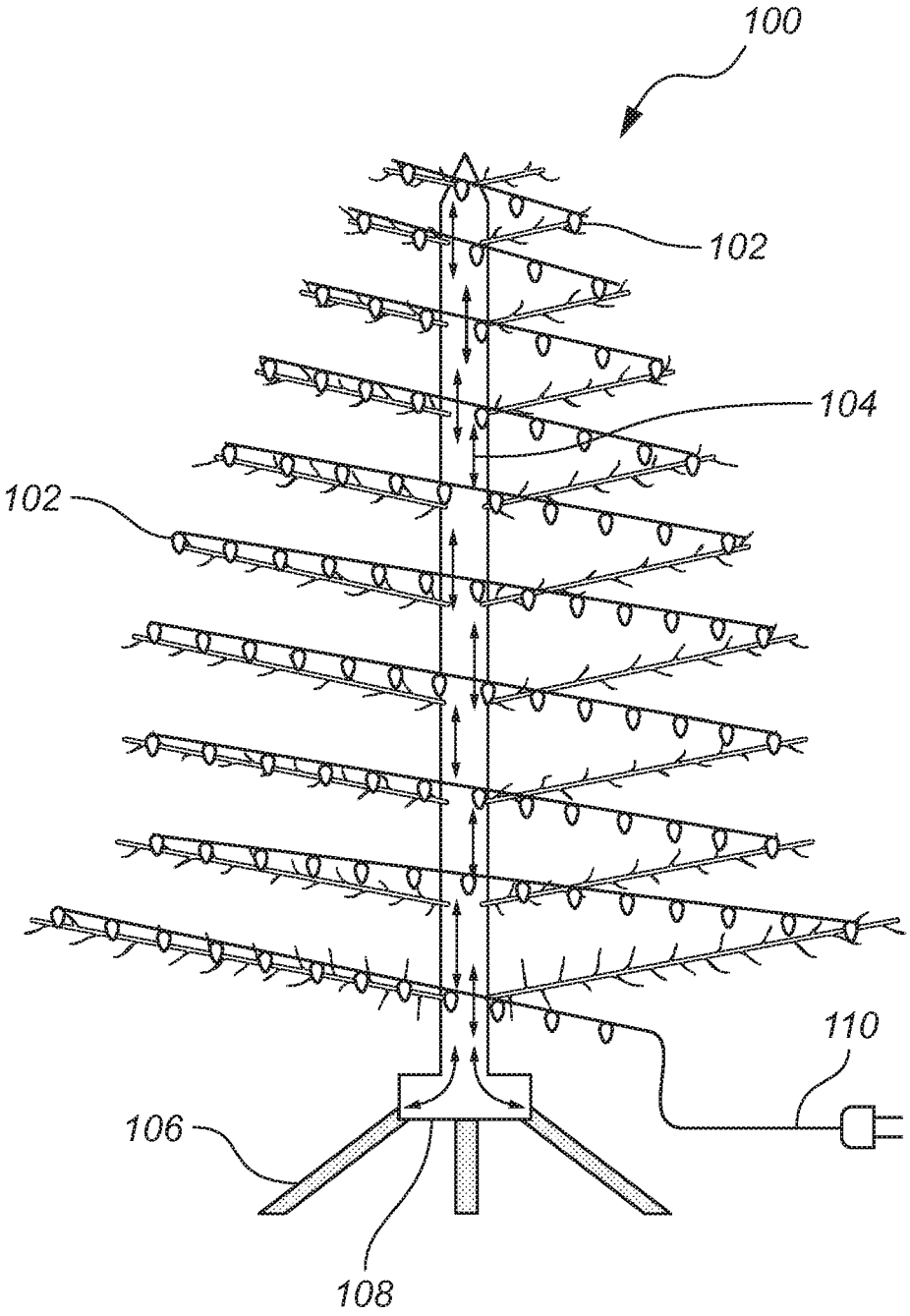
FIG. 1 is a drawing showing the current flow in a Christmas tree according to a theory of the present invention.

FIG. 1 depicts the inventor's theory for the generation and accumulation of electric potential in the water reservoir of the tree base. The lighted. Christmas tree 100 has Christmas lights 102 wrapped around it. The current in the lights' wire 110 creates an electric field, and therefore, a current flow 104 within the trunk of the tree 100. The current flows into the water reservoir 108 with no path to the neutral or ground. If the tree stand 106 is made of non-conducting material, then the charge in the water reservoir 108 is not grounded and accumulates.

Figure 2:
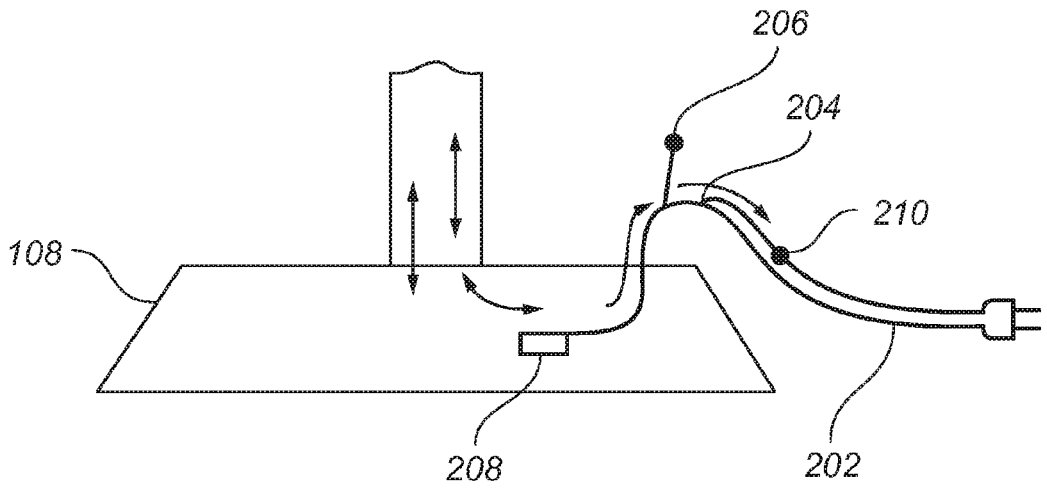
FIG. 2 is a drawing showing an embodiment of a grounded water reservoir having a probe.

FIG. 2 shows one embodiment of the water reservoir 108 as disclosed herein. A three-wire cord 202 is provided that provides the two wires necessary for an AC current and a third, ground, wire. At a juncture 204, the two live wires continue on to provide electricity to the Christmas lights. But the ground wire 206 is routed into the water reservoir where it terminates in a metal, or a conducting, electrode 208. The electrode 208 is in electrical communication with the water in the water reservoir 108. As the electricity reaches the water reservoir 108 due to the current 104 within the trunk, the electrode 208 conducts the electricity to earth, which prevents the accumulation of the electric potential in the water reservoir 108.

In some embodiments, provided is an indicator light 210, which is a safety feature and illuminates when the three-wire cord 202 is properly grounded.

In some embodiments, the electrode 208 is simply placed in the water reservoir 108. In other embodiments, the electrode 208 is embedded into the wall of the reservoir 108, while maintaining the electrical communication with both the three-wire cord and the water in the reservoir 108.

Figure 3:
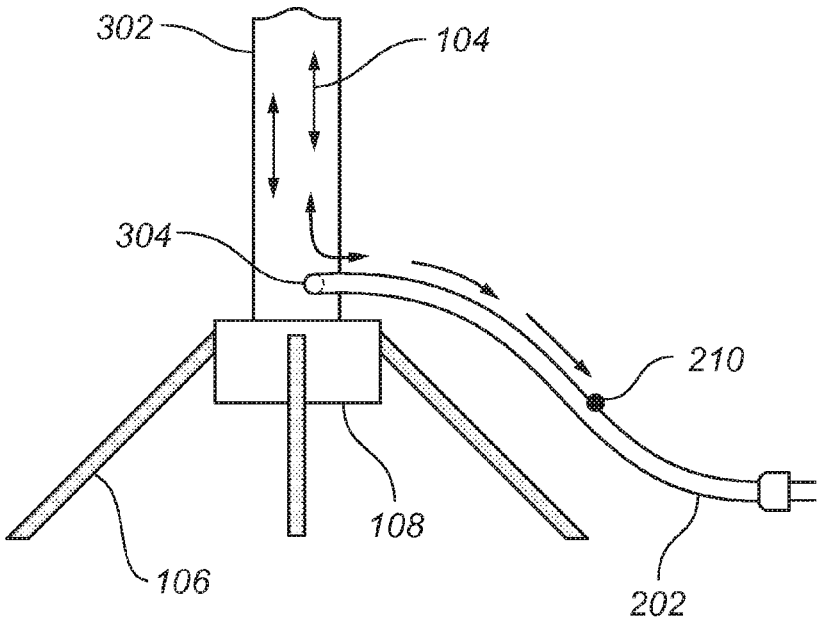
FIG. 3 is a drawing showing an embodiment of a grounded artificial tree.

FIG. 3 shows an embodiment of the disclosed grounded Christmas tree light for use with an artificial tree. The artificial tree trunk 302 is usually made up of a conducting metal, which can generate internal current 104, as discussed above. With an artificial tree, the lights at each limb plug into an outlet on the trunk. In some embodiments, a three-wire cord 202 is provided for plugging the tree into the wall socket. At the point 304 where the three-wire cord 202 enters the trunk 302, a ground connection is made between the ground wire of the three-wire cord 202 and the trunk 302. The current 104, then flows into earth. In some embodiments, the point 304 is on a limb of three, where the limb is made of a conducting material, for example a metal.

As discussed above, provided is an indicator light 210, which indicates the proper grounding of the three-wire cord 202.

Figure 4:
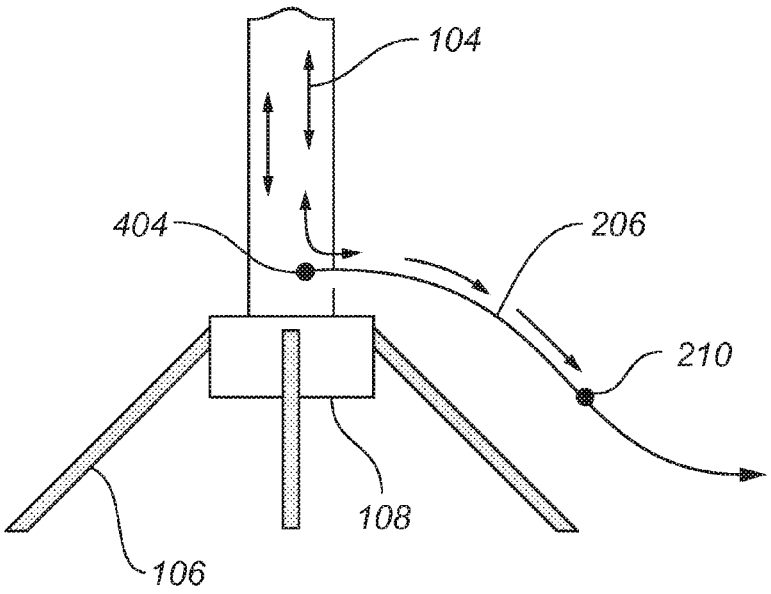
FIG. 4 is a drawing showing another embodiment of a grounded artificial tree.

As shown in FIG. 4, similar to an artificial tree of FIG. 3, in some embodiments the ground wire 206 for a fresh cut tree is connected directly to the tree trunk at a point 404. In some embodiments, the point 404 comprises a sharp object, similar to a nail, a needle, a tack, and the like, made of a conducting material, that can be inserted into the tree trunk. The sharp object is in electrical communication with the ground wire 206. By virtue of resting inside of the trunk, the sharp object comes also in electrical communication with the current 104 inside of the trunk and conducts that current to earth. In some embodiments, the sharp object is inserted into a limb of the tree.

In another aspect, disclosed herein is an extension cord for use with Christmas tree lights, where the extension cord comprises a ground wire connection, and an outlet for the Christmas tree lights to be plugged in. In these embodiments, the user, who may already have Christmas lights from the years past, is not required to acquire new lights. The user can only acquire the extension cord and use it with an existing tree and/or existing lights.

As discussed above, provided is an indicator Light 210, which indicates the proper grounding of the cord.

Figure 5A:
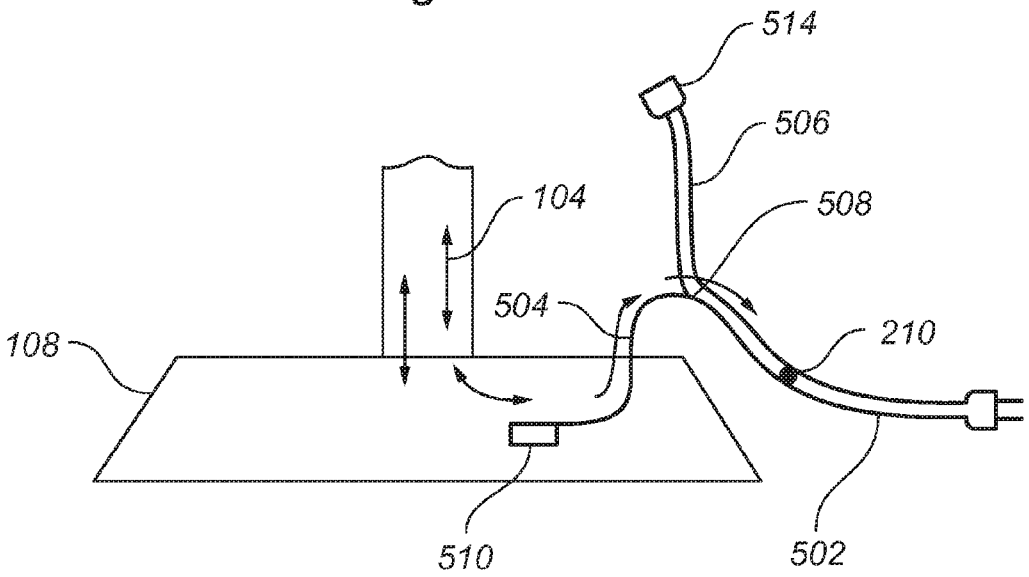

FIG. 5A depicts an embodiments of the extension cord disclosed herein. The extension cord 502 is a three-wire cord, comprising a ground wire 504. The ground wire 504 separates from the two live wires 506 at a juncture 508. In some embodiments, the ground wire 504 terminates in an electrode 510, similar to the one described above. This embodiment is most suitable for use with fresh cut trees that make use of a water reservoir 108. The electrode 510 can be placed inside the reservoir 108 to conduct the current 104 from the tree trunk to earth.

As discussed above, provided is an indicator light 210, which indicates the proper grounding of the three-wire cord 502.

Figure 5B:
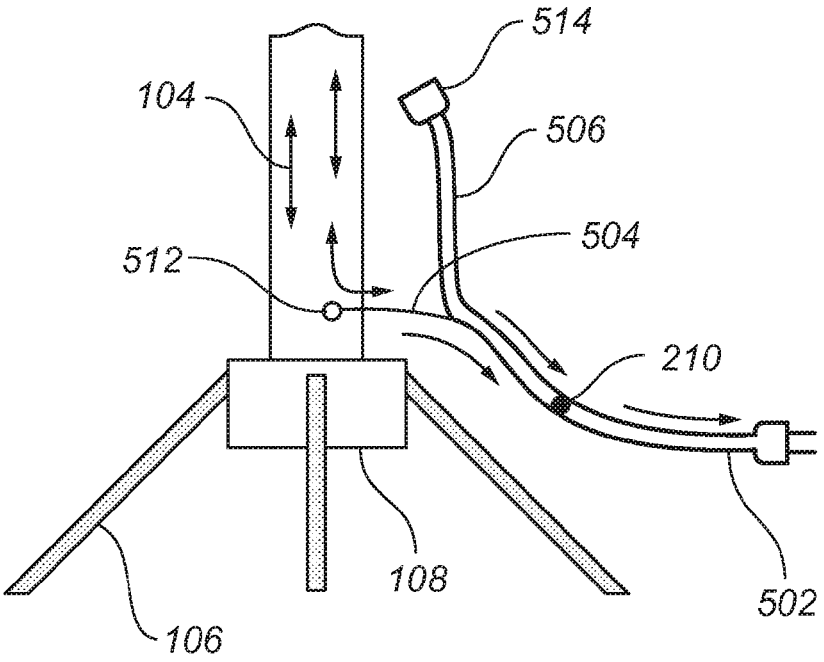
FIG. 5B is a drawing showing an embodiment of a grounded extension cord for use with an artificial tree.

In other embodiments, for example the one shown in FIG. 5B, the ground wire 504 connects to the tree trunk, or a tree limb, at a point 512, similar to the embodiments described above. This embodiment is most suitable for use with artificial trees, although it can be used with fresh cut trees as well as discussed above.

The two live wires 506 terminate at a female plug; 514, into which the existing Christmas light cord is plugged.

As discussed above, provided is an indicator light 210, which indicates the proper grounding of the three-wire cord 502.

Figure 6A:
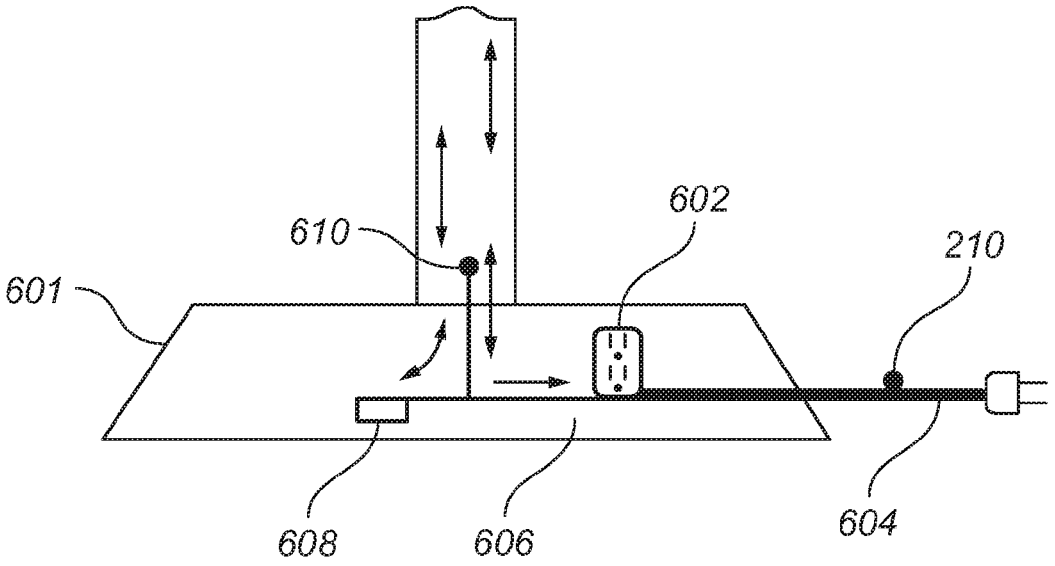

In another aspect, disclosed herein is a tree base having a grounded plug for Christmas tree lights. An embodiment of the disclosed base is shown in FIG. 6A. In some embodiments, the base 601 is configured to have a water reservoir for use with fresh cut trees. The base 601 comprises a socket 602 into which an existing Christmas tree light cord can be plugged in. In some embodiments, the socket 602 is a ground fault interrupter (GFI) socket, which are well-known in the art. The socket 602 is in electrical communication with a three-wire cord 604, which is configured to be plugged into a wall socket. A ground wire 606 can connect to an electrode 608 for placement in the water reservoir, or alternatively to a point 610 for connection with the tree trunk or a tree limb, as both alternatives are described above with respect to other embodiments. In some embodiments, the electrode 608 is simply placed in the water reservoir, whereas in other embodiments, the electrode 608 is built into the wall of the base 601.

As discussed above, provided is an indicator light 210, which indicates the proper grounding of the three-wire cord 604.

Figure 6B:
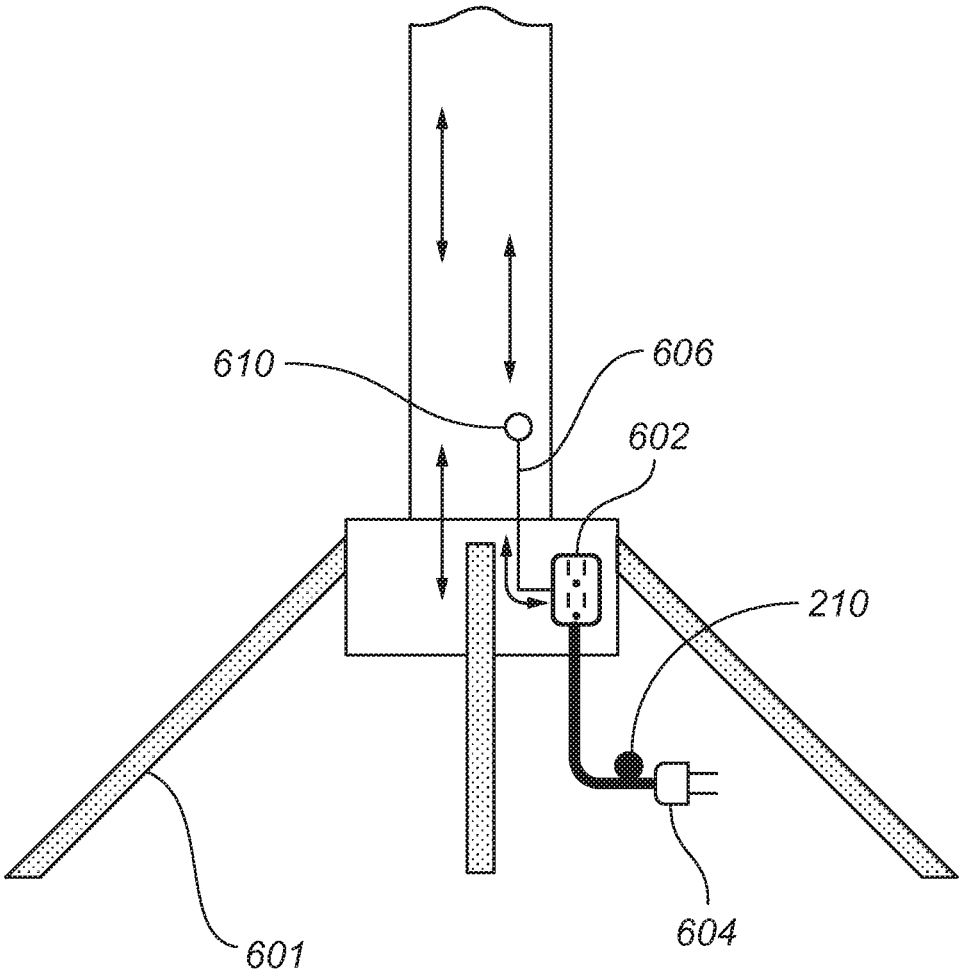
FIG. 6B is a drawing showing an embodiment of an artificial tree base having a GFI socket.

FIG. 6B shows the embodiment of the disclosed base 601, which is configured to hold an artificial tree, where the ground wire 606 connects to the tree trunk at the point 610.

As discussed above, provided is an indicator light 210, which indicates the proper grounding of the three-wire cord 604.

Additional embodiments are disclosed in the following non-limiting examples.

Examples

Trees #1 and 2:

A fresh cut tree (Tree #1) approximately 7' tall with five strands of lights, was mounted in a plastic stand on a tile floor. A 46 year old female received an electric shock when she stuck her hand in the basin to check the water level. The tree lights were plugged in and turned on. At the time, 47 V AC to ground was measured on Tree #1. When checked 9 days later, Tree #1 measured 50.6 V AC to ground.

The subject also had a second tree (Tree #2). This tree was approximately 5' tall with three strands of lights. It measured 30 V AC to ground. When checked 9 days later, Tree #2 measured 39.6 V AC to ground.

Tree #3:

A fresh cut tree (Tree #3) approximately 8' tall with four strands of lights, was mounted in a plastic stand on a tile floor. A 44 year old male received an electric shock when he stuck his hand in the water basin. As with the subject in Example A, he was making contact with the uninsulated floor. At the time, 68 V AC to ground was measured on Tree #3. When checked 9 days later, Tree #3 measured 31 V AC to ground.

Tree #4:

A fresh cut tree (Tree #4) approximately tall with four strands of lights, is mounted in a metal stand, on a carpeted floor. Tree #4 measured 40.3 V AC to ground.

Tree #3:

A three wire extension cord with an attached grounding probe was utilized with the tree lights of Tree #3. When the probe was placed in the water, the measured voltage was eliminated. When the probe was removed, the voltage was restored. This same application was used on Trees #1, and #4. This produced the same results.

Tree #5:

A fresh cut tree approximately 5' tall was mounted in a plastic stand. Four strands of lights produced 23.3 V AC measured to ground, from the water basin. Five strands of lights produced 30.4 V AC. Six strands of lights produced 36.5 V AC. Seven strands of lights produced 40.6 V AC. (Note: The tree had been on a tree lot for one week and seemed dry.)

When a grounded probe was placed in the water, the voltage was eliminated. When the probe was removed, the voltage was restored. Upon placing the grounded probe back in the water, the voltage was eliminated.

Tree #6:

A fresh cut tree approximately 8' tall was mounted in a plastic stand, with four strands of lights measured 52.8 V AC to ground, from the water. Also, 0.05 A of current was measured to ground. As tested before, when a grounded probe was placed in the water, the voltage was eliminated.

A grounded probe was placed in the water. This eliminated the voltage. When the probe was removed, the voltage returned.

Tree #7:

A fresh cut tree approximately 7' tall was mounted in a plastic stand, with twelve strands of lights measured 53 V AC to ground from the water. Also, 0.06 A of current was measured to ground.

Tree #8:

A fresh cut tree approximately 5' tall was mounted in a plastic stand, with five strands of lights measured 49 V AC to ground and 0.05 A of current was measured. As tested before, when a grounded probe was placed in the water, the voltage was eliminated. When the probe was removed, the voltage returned.

Tree #9:

An artificial tree approximately 5' tall with rubber pads on the legs of the stand was tested. The tree only had three strands of lights, but still produced 19.8 V AC measured voltage from the frame of the tree to ground. A grounded conductor was attached to the frame of the tree. This eliminated the voltage readings. When the conductor was removed, the voltage returned.

What is claimed is:

1. A cord for grounding a metal artificial tree or a water reservoir of a cut, live, natural tree, the cord comprising:

two live wires, wherein the two live wires terminate at a male plug at a distal end, and the two live wires are in electrical communication with a string of lights wrapped around the artificial or natural tree; and a ground wire, wherein the ground wire terminates at the male plug at the distal end and in an electrode at the proximal end, wherein the electrode is not in direct electrical communication with the string of lights;

wherein:

i) when the cord is used for grounding the water reservoir of the cut, live, natural tree, the water reservoir is electrically non-conducting, the electrode is embedded in the body of the water reservoir, and the electrode is in electrical communication with water in the water basin; or ii) when the cord is used for grounding a metal artificial tree, the electrode is attached to a metal portion of the artificial tree.

2. The cord of claim 1, wherein the socket is a GFI socket.

3. The cord of claim 1, wherein the electrode is a sharp-pointed metal piece.

4. The cord of claim 3, wherein the electrode has a length of at leach one inch.

5. A water reservoir for a cut, live, natural tree, the water reservoir comprising a GFI socket, wherein the water reservoir is electrically non-conducting, wherein the GFI socket is in electrical communication with a cord for grounding the water reservoir, the cord comprising:

two live wires, wherein the two live wires terminate at a male plug at a distal end and the two live wires are in electrical communication with a string of lights wrapped around the artificial or natural tree; and a ground wire, wherein the ground wire terminates at the male plug at the distal end and in an electrode at the proximal end, wherein the electrode is not connected to or part of the female socket;

wherein the electrode is embedded in the body of the water reservoir, and the electrode is in electrical communication with water in the water reservoir.

6. A method for grounding a metal artificial tree or a water reservoir of a cut, live, natural tree, wherein the tree is wrapped in at least one strand of lights, the method comprising the steps of:

providing a cord, the cord comprising:

two live wires, wherein the two live wires terminate at a male plug at a distal end and the two live wires are in electrical communication with a string of lights wrapped around the artificial or natural tree; and a ground wire, wherein the ground wire terminates at the male plug at the distal end and in an electrode at the proximal end, wherein the electrode is not connected to or part of the female socket;

wherein:

i) when the cord is used for grounding the water reservoir of the cut, live, natural tree, the water reservoir is electrically non-conducting, the electrode is embedded in the body of the water reservoir, and the electrode is in electrical communication with water in the water basin; or ii) when the cord is used for grounding a metal artificial tree, the electrode is attached to a metal portion of the artificial tree;

electrically connecting the electrode to the artificial tree or the water reservoir.

* * * * *